US010927311B2

(12) United States Patent
Dath et al.

(10) Patent No.: US 10,927,311 B2
(45) Date of Patent: Feb. 23, 2021

(54) PROCESS FOR THE DEAROMATIZATION OF PETROLEUM CUTS

(71) Applicant: TOTAL MARKETING SERVICES, Puteaux (FR)

(72) Inventors: Jean Pierre Dath, Beloeil Hainault (BE); Delphine Minoux, Nivelles (BE); Orianne Chassard, Le Havre (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 15/321,359

(22) PCT Filed: Jul. 1, 2015

(86) PCT No.: PCT/EP2015/064982
§ 371 (c)(1),
(2) Date: Dec. 22, 2016

(87) PCT Pub. No.: WO2016/001302
PCT Pub. Date: Jan. 7, 2016

(65) Prior Publication Data

US 2017/0158969 A1 Jun. 8, 2017

(30) Foreign Application Priority Data

Jul. 1, 2014 (FR) ..... 1456285

(51) Int. Cl.
*C10G 45/44* (2006.01)
*C10G 65/08* (2006.01)
*C10G 67/02* (2006.01)

(52) U.S. Cl.
CPC ..... *C10G 45/44* (2013.01); *C10G 65/08* (2013.01); *C10G 67/02* (2013.01);
(Continued)

(58) Field of Classification Search
CPC combination set(s) only.
See application file for complete search history.

(56) References Cited

U.S. PATENT DOCUMENTS 2,332,572 A * 10/1943 Hepp ..... C07C 5/02
585/263
3,549,519 A 12/1970 Munro et al.
(Continued)

FOREIGN PATENT DOCUMENTS

WO WO-99/47626 A1 9/1999

*Primary Examiner* — Michelle Stein
(74) *Attorney, Agent, or Firm* — Harness, Dickey & Pierce, PLC

(57) ABSTRACT

A process for dearomatization of a petroleum cut produces a dearomatized hydrocarbon-containing fluid with a sulphur content less than or equal to 5 ppm and a content of aromatic compounds less than or equal to 300 ppm, the hydrocarbon-containing fluid has a boiling point between 100 and 400° C. according to the standard ASTM D-86 and a distillation range defined by the difference between the Initial Boiling Point (IBP) and the Final Boiling Point (FBP) determined by the standard ASTM D-86 not exceeding 80° C. The process includes at least one dearomatization cycle utilizing a mixture of the petroleum cut with one or more inert and light diluents having a distillation range not exceeding 80° C.

14 Claims, 3 Drawing Sheets

(52) U.S. Cl.
CPC ..... *C10G 2300/1059* (2013.01); *C10G 2300/4081* (2013.01); *C10G 2300/708* (2013.01); *C10G 2300/802* (2013.01)

(56) References Cited

U.S. PATENT DOCUMENTS

| | | | | |
|---|---|---|---|---|
| 3,759,819 | A | 9/1973 | Reeg et al. | |
| 3,900,388 | A * | 8/1975 | Hilfman | B01J 23/40 208/143 |
| 4,347,124 | A | 8/1982 | Shimoiizaka et al. | |
| 4,447,315 | A | 5/1984 | Lamb et al. | |
| 5,954,941 | A | 9/1999 | Mercier et al. | |
| 7,291,257 | B2 | 11/2007 | Ackerson et al. | |
| 7,575,668 | B1 * | 8/2009 | Nafis | C10G 25/05 208/57 |
| 8,741,126 | B2 | 6/2014 | Demoment | |
| 8,785,354 | B2 | 7/2014 | Westelynck et al. | |
| 9,382,173 | B2 | 7/2016 | Yanagawa et al. | |
| 2005/0082202 | A1 | 4/2005 | Ackerson et al. | |
| 2010/0122932 | A1 | 5/2010 | Haizmann et al. | |
| 2011/0303585 | A1 | 12/2011 | Dath et al. | |
| 2012/0010109 | A1 | 1/2012 | Westelynck et al. | |
| 2012/0283492 | A1 * | 11/2012 | Dalemat | C10G 45/48 585/16 |

* cited by examiner

PROCESS FOR THE DEAROMATIZATION OF PETROLEUM CUTS

CROSS-REFERENCE TO RELATED APPLICATIONS

This application is a National Phase Entry of International Patent Application No. PCT/EP2015/064982, filed on Jul. 1, 2015, which claims priority to French Patent Application Serial No. 1456285, filed on Jul. 1, 2014, both of which are incorporated by reference herein.

TECHNICAL FIELD

The invention relates to a process for the dearomatization of a petroleum cut to produce a dearomatized hydrocarbon-containing fluid having a very low sulphur content and having a very low content of aromatic compounds. In particular, the invention relates to a process for the deep dearomatization of a petroleum cut comprising at least one dearomatization cycle utilizing a mixture of the petroleum cut with one or more inert and light diluents, said diluent having a distillation range which does not exceed 80° C. The invention also relates to the dearomatized hydrocarbon-containing fluids originating from said process and the use thereof. The invention similarly relates to a device for the implementation of said process.

BACKGROUND

Hydrocarbon-containing fluids are widely used as solvents, for example in adhesives, cleaning fluids, explosives, solvents for decorative coatings, paints and printing inks. Light hydrocarbon-containing fluids are used in applications such as metal extraction, metal working or mould release, industrial lubricants and drilling fluids. Hydrocarbon-containing fluids can also be used as dilution oils for adhesives and sealing systems such as silicone mastics, as viscosity reducers in formulations based on plasticized polyvinyl chloride, as solvents in polymer formulations serving as flocculants, for example in water treatment, during mining operations or in paper manufacture and also as thickeners in printing pastes. Moreover, hydrocarbon-containing fluids can be used as solvents in a very wide range of other applications, such as chemical reactions.

The chemical nature and composition of hydrocarbon-containing fluids vary considerably according to the intended use of the fluid. Important properties of hydrocarbon-containing fluids are the distillation range (generally determined according to the standards ASTM D-86 or ASTM D-1160 by the vacuum distillation technique used for heavier materials), flash point, density, aniline point (determined according to the standard ASTM D-611), content of aromatics, sulphur content, viscosity, colour and refractive index. These fluids can be classified as paraffinic, isoparaffinic, dearomatized, naphthenic, non-dearomatized and/or aromatic.

These fluids tend to have narrow boiling point ranges as indicated by a narrow range between the Initial Boiling Point (IBP) and the Final Boiling Point (FBP) determined according to the standard ASTM D-86. The Initial Boiling Point and the Final Boiling Point will be selected according to the intended use of the fluid. However, the use of narrow cuts provides the benefit of a precise flash point which is important for safety reasons. The narrow cut also confers important properties upon the fluid, for example a better defined aniline point or solvent power, as well as viscosity and defined evaporation conditions for systems in which drying is important, and finally more precise surface tension. This distillation range is preferably less than 80° C.

In order to produce these hydrocarbon-containing fluids, the petroleum cuts used as feedstocks are treated in hydrodearomatization units by a catalytic hydrogenation process composed for example of several reactors in series operated at high pressure. These reactors have one or more catalytic beds. These units are composed of main treatment sections which are generally: the feedstock storage unit, the hydrogenation section with several reactors and the distillation column. To this end, see FIG. 4.

The configuration generally installed for the hydrogenation section is a sequence of several reactors in series. The efficiency of the unit for hydrodearomatization by hydrogenation is dependent on the stability and the performance of the catalysts in these reactors. The hydrogenated effluent is then distilled into finished products. The catalysts generally used in the hydrogenation section are nickel- or noble metal-based. The hydrogenation reaction being highly exothermic, the temperature of the first hydrogenation reactor is controlled by diluting the feedstock called "fresh" feedstock with an unreactive diluent. As diluent, it is known to use a portion of the hydrogenated feedstock, i.e. the hydrogenated effluent, which is thus returned to the inlet of the first reactor and mixed with the feedstock to be treated before entry via recycling (typically 50/50% by weight fresh feedstock/hydrogenated feedstock). Thus, this recycling makes it possible to control the exothermicity of the hydrogenation reaction.

In order to produce specific hydrocarbon-containing fluids, the preferred feedstocks are specific gasoil cuts, such as feedstocks with a low sulphur content. A typical feedstock could, for example, correspond to a hydrocracked vacuum gasoil (HCVGO). Certain feedstocks considered as conventional can lead to an immediate and progressive deactivation of the catalysts. For example, feedstocks that are refractory, heavy and difficult to treat. Refractory and heavy feedstocks are potentially feedstocks having a sulphur content greater than 5 ppm, a content of polyaromatic molecules greater than 1% by weight, a final distillation point greater than 330° C. and a high content of naphtheno-aromatic compounds. These compounds being the most refractory to hydrodearomatization, these feedstocks therefore present a greater risk of increased deactivation of the catalyst.

All of the conventional feedstocks produced in refineries therefore cannot be used in the hydrodearomatization process. If the feedstocks produced in a refinery contain either a greater content of aromatic compounds or molecules that are more refractory to hydrodearomatization then the dearomatization step will be difficult to carry out, the deactivation of the catalytic beds of the reactors will be greatly accelerated and the technical specifications of the final products will not be met. It is therefore difficult to use a conventional gasoil produced in a refinery, even if these feedstocks are widely available in comparison to specific gasoils.

U.S. Pat. No. 7,291,257 describes a method for the hydrotreatment of a petroleum feedstock including the use of a solvent/diluent which can be a portion of the hydrogenated feedstock or also a diesel and having the sole role of increasing the percentage of hydrogen in solution. Similarly, patent application WO 2012133138 also refers to the use of a diluent making it possible to reduce the exothermicity of the hydrogenation reaction of polycyclic aromatics of a heavy petroleum cut obtained by catalytic reforming which is then reformed again in order to obtain a monoaromatic hydrocarbon-containing cut. In this patent application, the diluent corresponds to a portion of the hydrogenation reaction product of the heavy distillate.

The dilution steps found in the literature to date only make it possible to limit the exothermicity of the hydrogenation reaction by dilution of the feedstock to be treated with its hydrogenated effluent. No solution is provided relating to the increased deactivation of the catalytic beds during the use of conventional refinery feedstocks in order to obtain the products originating from the reaction as desired. The aromatic compounds that are largely responsible for the deactivation of the catalysts can in fact be reintroduced via the hydrogenated effluent mixed with the feedstock to be treated. The use of conventional refinery feedstocks mixed with the diluents existing in the state of the art therefore does not make it possible to reduce catalytic deactivation and to obtain the specificities required of the hydrocarbon-containing fluids produced.

One of the main objectives of the invention is to provide a process for the preparation of the hydrocarbon-containing fluids with an increased flexibility of supply feedstocks. Another objective of the invention is to provide an optimised process for the production of hydrocarbon-containing fluids making it possible to deeply dearomatize conventional refinery feedstocks. An objective of the invention is also to obtain an increased conversion rate of aromatic compounds during the dearomatization of conventional refinery feedstocks. Another objective of the invention is furthermore to control and to limit the deactivation of the catalysts of the hydrogenation reactor during the treatment of conventional refinery feedstocks. An objective of the invention is also to increase the service life of the hydrogenation catalysts during the treatment of conventional refinery feedstocks.

SUMMARY

These objectives are achieved using a novel type of dearomatization process. The invention relates to a process for the dearomatization of a petroleum cut to produce a dearomatized hydrocarbon-containing fluid having a sulphur content less than or equal to 5 ppm and having a content of aromatic compounds less than or equal to 300 ppm, said hydrocarbon-containing fluid having a boiling point comprised between 100 and 400° C. according to the standard ASTM D-86 and a distillation range defined by the difference between the Initial Boiling Point (IBP) and the Final Boiling Point (FBP) determined according to the standard ASTM D-86 not exceeding 80° C., said process comprising at least one dearomatization cycle utilizing a mixture of the petroleum cut with one or more inert and light diluents having a distillation range which does not exceed 80° C. Advantageously, the process comprises at least one dilution step in which the diluent is constituted by a single inert and light diluent selected from the saturated hydrocarbon-containing compounds, preferably paraffinic, alone or in a mixture.

Preferably, the dearomatization cycle of the process according to the invention is a catalytic hydrogenation carried out at a temperature comprised between 80 and 300° C. and at a pressure comprised between 20 and 200 bar. According to an embodiment, the mass ratio between the petroleum cut and the inert and light diluent according to the invention is comprised between 10/90, preferably 30/70 and more preferentially 50/50. Preferably, the inert and light diluent according to the invention is separated from the hydrogenated product obtained after the dearomatization cycle by distillation and is then recycled.

Preferably, the inert and light diluent according to the invention has a distillation range comprised between 100 and 250° C., preferably between 140 and 200° C. according to the standard ASTM D-86 and a difference between its Initial Boiling Point and its Final Boiling Point less than or equal to 80° C. According to the invention, the Final Boiling Point of the inert and light diluent is preferably lower than the Initial Boiling Point of the petroleum cut to be treated by at least 10° C., more preferentially by 20° C.

Preferably, the inert and light diluent according to the invention is saturated and more preferentially paraffinic. Preferably, the inert and light diluent according to the invention contains a majority of isoparaffins and a minority of normal paraffins. Preferably, the inert and light diluent according to the invention contains more than 90% by weight of isoparaffins and more preferentially more than 99% of isoparaffins.

Preferably, the inert and light diluent according to the invention has a content of aromatics less than 50 ppm, preferably less than 20 ppm measured by UV spectrometry. Preferably, the inert and light diluent according to the invention has a content of benzene compounds less than 10 ppm by weight, preferably less than 1 ppm according to the standard ASTM D-6229. Preferably, the inert and light diluent according to the invention has a sulphur content less than 2 ppm, preferably less than 1 ppm according to the standard ASTM D-5453. Preferably, the inert and light diluent according to the invention has a kinematic viscosity at 20° C. comprised between 0.75 and 204 $mm^2/s$, preferably between 1 and 1.5 $mm^2/s$ and more preferentially between 1.1 and 1.4 $mm^2/s$ according to the standard EN ISO 3104.

Preferably, the inert and light diluent according to the invention is a hydrocarbon-containing cut obtained by atmospheric distillation, vacuum distillation, catalytic cracking, oligomerization and/or hydrogenation of crude oil. Preferably, the inert and light diluent according to the invention is a hydrocarbon-containing cut obtained by the oligomerization and hydrogenation of a propylene cut or a butylene cut. Preferably, the inert and light diluent according to the invention is a gasoline cut or a kerosene cut originating from the oligomerization and the hydrogenation of a propylene cut or a butylene cut. Preferably, the petroleum cut according to the invention has a sulphur content less than 15 ppm, preferentially less than 10 ppm or even less than 5 ppm according to the standard EN ISO 20846.

According to an embodiment, the dearomatized hydrocarbon-containing fluids obtained by the process according to the invention preferably have:

- a sulphur content less than or equal to 5 ppm, preferably less than 3 ppm or even less than 0.5 ppm.
- a content of aromatics less than or equal to 300 ppm, preferably less than 100 ppm or even less than 50 ppm.
- a content of naphthenes less than 60% by weight, preferably less than 50% or even less than 40% and/or
- a content of polynaphthenes less than 30% by weight, preferably less than 25% or even less than 20% and/or
- a content of paraffins greater than 40% by weight, preferably greater than 60% or even greater than 70% and/or
- a content of isoparaffins greater than 20% by weight, in particular greater than 30% or even greater than 40%.

Another subject of the invention is the use of dearomatized hydrocarbon-containing fluids obtained by the process according to the invention as drilling fluids, as industrial solvents, as cutting fluids, as rolling oils, as electro-discharge machining fluids, as rust preventatives in industrial lubricants, as dilution oils, as viscosity reducers in formulations based on plasticized polyvinyl chloride, as crop protection fluids. A subject of the invention is also the use of dearomatized hydrocarbon-containing fluids obtained by the process according to the invention in coating fluids, in metal extraction, in the mining industry, in explosives, in mould release formulations for concrete, in adhesives, in printing inks, in metal working fluids, in sealing products or polymer formulations based on silicone, in resins, in pharmaceutical products, in cosmetic formulations, in paint compositions, in polymers used in water treatment, in paper manufacture or in printing pastes or cleaning solvents. A subject of the invention is equally the use of the inert and light diluent mixed with a petroleum cut for a dearomatization process in order to improve the hydrogenation yield and reduce deactivation of the catalyst. The invention also relates to a device for implementing the process according to the invention comprising at least two hydrogenation reactors connected in series, each having at least one catalytic bed, at least one distillation column at the outlet of the reactors and a column (also called separation column in FIG. 3) for the extraction of the inert and light diluent from the dearomatized hydrocarbon-containing fluid placed between the reactors and the distillation column.

BRIEF DESCRIPTION OF THE FIGURES

Attached

DETAILED DESCRIPTION

Figure 1:
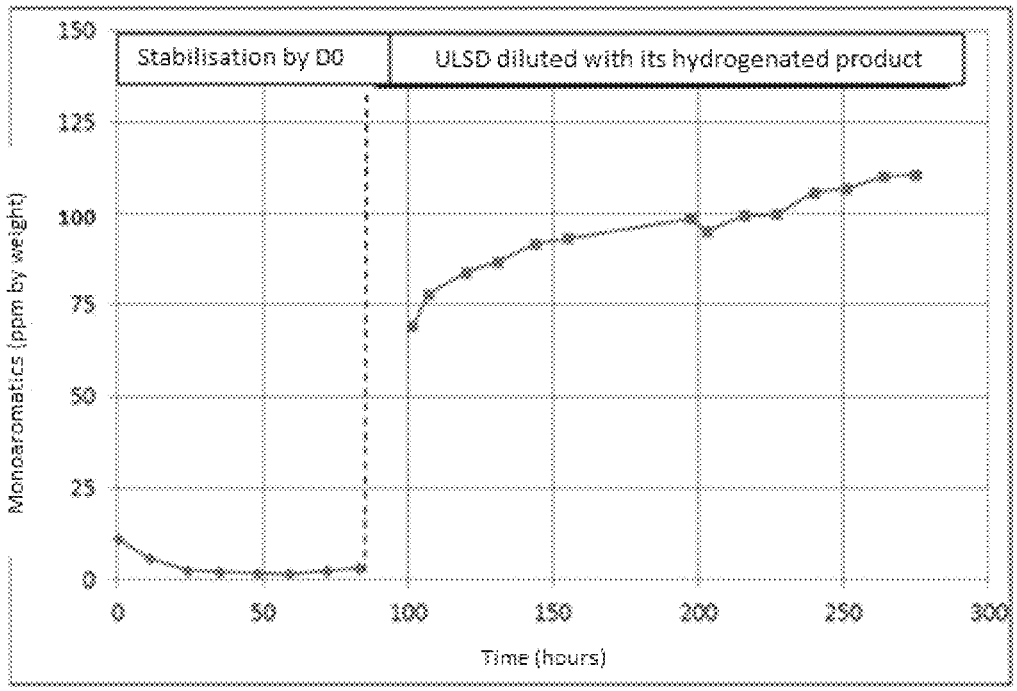
FIGS. 1-3 are a diagrammatic representation of the deep dearomatization unit according to the process of the invention and of the results obtained.

The process according to the invention relates to an improvement in the operating conditions of the hydrogenation reactors of a dearomatization unit allowing the production of dearomatized hydrocarbon-containing fluids. The process according to the invention relates in particular to the use of an inert and light solvent as diluent of the feedstock to be treated in order to limit the deactivation of the catalytic beds of the hydrogenation reactor, in order to improve the conversion and the hydrogenation yield and thus allow the hydrodearomatization of conventional refinery feedstocks originating from petroleum cuts for the production of said dearomatized hydrocarbon-containing fluids.

Diluent:

The process of the present invention comprises a step of dilution of the feedstock with a light and inert solvent. By "light" is meant a solvent that can be easily separated by distillation, preferably atmospheric or gentle vacuum distillation, from the hydrogenated effluent at the outlet of the hydrogenation section. By "hydrogenated effluent" is meant the product of the hydrogenated feedstock, i.e. the product originating from the feedstock obtained at the outlet of the hydrogenation section before the distillation section. Preferably, the Final Boiling Point of the light and inert solvent is less than the Initial Boiling Point of the petroleum cut to be treated by at least 10° C., more preferentially by 20° C. By "inert" is meant a solvent, preferentially paraffinic, that does not react chemically with the feedstock to be treated with which it is mixed. Without being bound by this theory, the inertness of the feedstock may be caused by the nature of the paraffins and the quantity of the paraffins, in particular of the isoparaffins. Moreover, it is understood that the inert and light diluent according to the invention does not correspond to the product of the hydrogenated feedstock. The inert and light diluent is not the hydrogenated effluent.

The inert and light diluent is, advantageously, a hydrocarbon-containing cut having a distillation range DR (in ° C.) comprised between 100 and 250° C., preferably between 140 and 200° C. according to the standard ASTM D-86 and the difference between the Initial Boiling Point and the Final Boiling Point of which is less than or equal to 80° C. The diluent can comprise one or more fractions of distillation ranges comprised in that of said cut. According to a particular embodiment, the inert and light diluent is entirely saturated and preferentially paraffinic. Preferably, the diluent is constituted by branched C7-C14 alkanes, preferably C9-12 alkanes.

The inert and light diluent is advantageously constituted by a majority of isoparaffins and a minority of normal paraffins. Preferably, the diluent contains more than 90% by weight of isoparaffins and more preferentially more than 99% of isoparaffins determined by GC-MS. The inert and light diluent is preferably free of aromatics. By "free of" is meant less than 50 ppm of aromatics, and more preferentially less than 20 ppm of aromatics measured by UV spectrometry. The inert and light diluent is preferably free of benzene compounds. By "free of" is meant less that 10 ppm of benzene compounds and more preferentially less than 1 ppm of benzene compounds according to the standard ASTM D-6229.

Preferably, the inert and light diluent has a typical sulphur content less than 2 ppm and preferentially less than 1 ppm according to the standard ASTM D-5453. The inert and light diluent generally has a typical kinematic viscosity at 20° C. comprised between 0.75 and 2.04 $mm^2/s$, preferably between 1 and 1.5 $mm^2/s$ and more preferentially between 1.1 and 1.4 $mm^2/s$ according to the standard EN ISO 3104. The inert and light diluent preferably has a typical pour point according to the standard ASTM D-97 comprised between −40 and −60° C., preferably comprised between −50 and −60° C. The inert and light diluent preferably has an aniline point according to the standard ISO 2977 comprised between 50 and 80° C., preferably between 55 and 70° C. Moreover, the inert and light diluent has the advantage of being easily available on the market and being relatively economical within the chain of products originating from oil distillation.

The inert and light solvent used as a diluent according to the invention is a hydrocarbon-containing cut. By "hydrocarbon-containing cut" within the meaning of the invention, is meant a cut originating from the distillation of crude oil, preferably originating from the atmospheric distillation and/or vacuum distillation of crude oil, preferably originating from atmospheric distillation followed by vacuum distillation. The hydrocarbon-containing cut according to the invention is preferably a light cut originating from a propylene or a butylene cut, more preferentially a gasoline or a kerosene cut.

The hydrocarbon-containing cut according to the invention is also preferably subjected to steps of catalytic cracking, oligomerization and/or of hydrogenation at high pressure. The hydrocarbon-containing cut can be a mixture of hydrocarbon-containing cuts undergoing the steps described above.

Feedstocks to be Treated:

By "feedstocks to be treated" according to the invention, is meant petroleum cuts to be treated originating from oil refining. In accordance with the invention, typical refinery feedstocks can be of any type, including feedstocks originating from a distillate hydrocracker unit, but also feedstocks with high contents of aromatics such as conventional ultra-low sulphur diesel feedstocks, heavy diesel or fuels intended for aviation, or also particular fractions of these feedstocks.

Conventional ultra-low sulphur diesel (ULSD) generally contains less than 10 ppm of sulphur (measured in accordance with the method of the standard EN ISO 20846), its density is comprised between 0.820 and 0.845 g/cm$^3$ (measured in accordance with the method of the standard EN ISO 12185) and it generally meets the specifications required by the Euro V diesel standard and defined in European Directive 2009/30/EC. It is generally obtained by a severe hydrodesulphurization of straight run gasoil cuts from atmospheric distillation. Conventional refinery feedstocks can also be hydrocracked in order to obtain shorter and simpler molecules by the addition of hydrogen at high pressure in the presence of a catalyst. Descriptions of hydrocracking processes are provided in Hydrocarbon Processing (November 1996, pages 124 to 128), in Hydrocracking Science and Technology (1996) and in U.S. Pat. Nos. 4,347,124, 4,447,315 and WO-A-99/47626.

Prefractionation:

A step of prefractionation of the petroleum cut to be treated can optionally be carried out before the introduction of the petroleum cut into the hydrogenation unit as a feedstock. The optionally prefractionated petroleum cuts are then diluted and hydrogenated.

Dilution:

The dilution rate of the process according to the invention can vary from 10/90 to 50/50% by weight of the feedstock to be treated/diluent, and preferably from 30/70 to 50/50% by weight. Preferentially, the petroleum cut as feedstock to be treated is only diluted with a single light and inert diluent as described above, or a mixture constituted by several diluents as described above. According to a particular embodiment, mixtures of these inert and light diluents with other known diluents, for example aromatic diluents such as benzene and its derivatives, are excluded.

Figure 3:
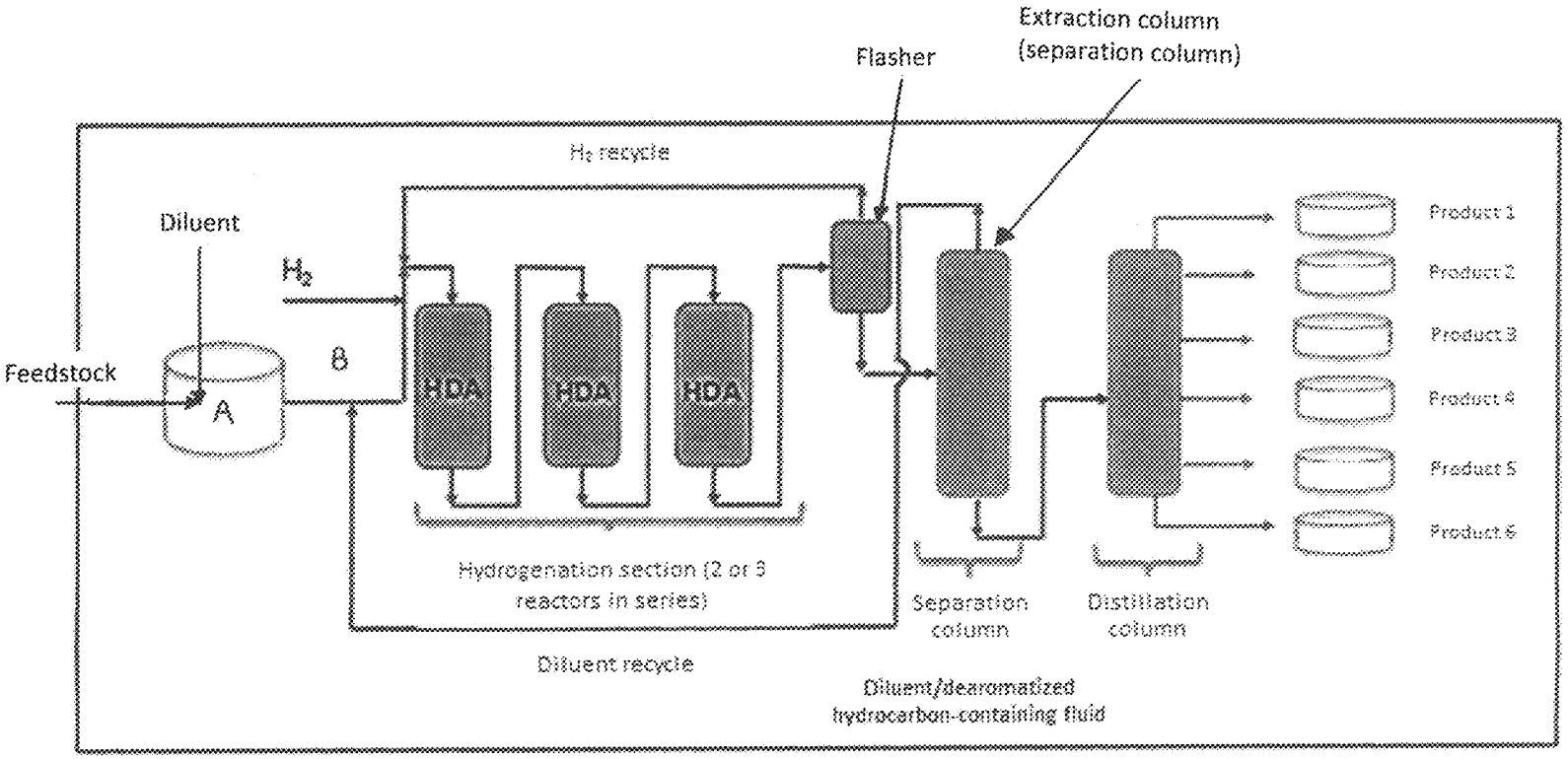
Figure 4:
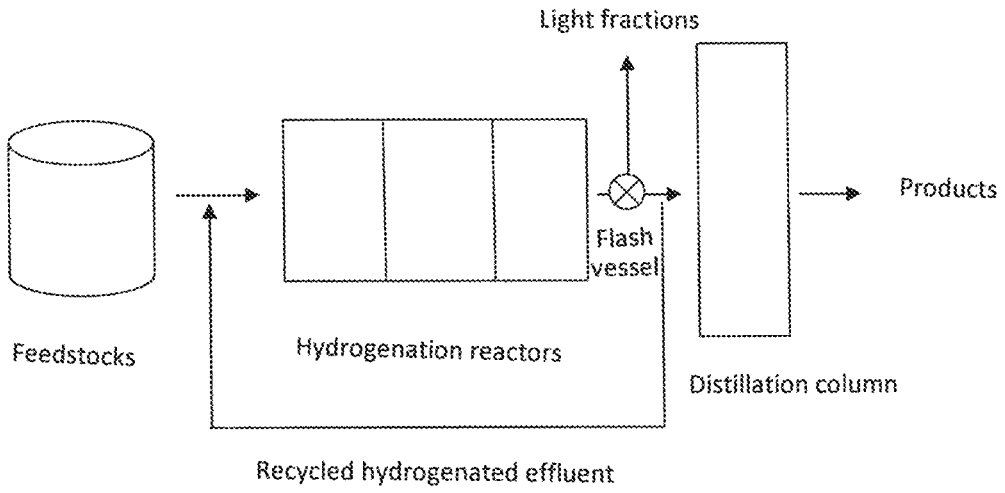
FIG. 4 is a general layout of a conventional dearomatization process.

Advantageously, the process comprises at least one dilution step in which the diluent is constituted by a single inert and light diluent selected from the saturated hydrocarbon-containing compounds, preferentially paraffinic, alone or in a mixture. The mixing points of the diluent with the feedstock are shown in FIG. 3. This can be "fresh" diluent introduced at point A or diluent recovered by distillation at the outlet of the hydrogenation section and then separated from the effluent. In this second case, it is introduced at point B.

Hydrogenation:

The hydrogen which is used in the hydrogenation unit is typically a high-purity hydrogen, the purity of which, for example, exceeds 99%, but other levels of purity can also be used. The hydrogenation takes place in one or more reactors in series. The reactors can comprise one or more catalytic beds. The catalytic beds are generally fixed catalytic beds.

The hydrogenation process of the present invention preferably comprises two or three reactors, preferably three reactors, and is more preferentially carried out in three reactors in series. The first reactor allows the hydrogenation of essentially all the unsaturated compounds and up to approximately 90% of the aromatic compounds. In the second stage i.e. in the second reactor, the hydrogenation of the aromatics continues and up to 99% of the aromatics are consequently hydrogenated. The third stage in the third reactor is a finishing stage making it possible to obtain contents of aromatics less than 300 ppm, preferably less than 100 ppm and more preferentially less than 50 ppm, even in the case of products with a high boiling point, for example, greater than 300° C. In general, fractions with a high boiling rate contain heavy aromatic compounds that are difficult to dearomatize.

Typical hydrogenation catalysts can be either bulk or supported and can comprise the following metals: nickel, platinum, palladium, rhenium, rhodium, nickel tungstate, nickel molybdenum, molybdenum, cobalt molybdenum. The supports can be of silica, alumina or silica-alumina or zeolites. A preferred catalyst is a nickel-based catalyst on an alumina support, the specific surface area of which varies between 100 and 200 m$^2$/g of catalyst, or a nickel-based bulk catalyst.

Typical hydrogenation conditions are as follows:

- Pressure: 20 to 200 bar, preferably 60 to 180 bar and more preferentially 100 to 160 bar
- Temperature: 80 to 300° C., preferably 120 to 250° C. and more preferentially 160 to 200° C.
- Liquid hourly space velocity (LHSV): 0.2 to 5 h-1, preferably 0.5 to 3 and more preferably 0.8 to 2
- treatment rate: 50 to 300 Nm$^3$/tonne of feedstock, preferably 80 to 250 and more preferably 100 to 200.

Advantageously, hydrogenation is utilized under the conditions mentioned above until dearomatized hydrocarbon-containing fluids with a very low content of aromatics, preferably less than 300 ppm, preferentially less than 100 ppm and more preferentially less than 50 ppm, are obtained. Advantageously, hydrogenation is utilized under the conditions mentioned above until a conversion rate of the aromatic compounds comprised between 95 and 100%, preferably between 98 and 99.99%, is obtained.

Under these conditions, the content of aromatics of the final product will remain very low, typically less than 300 ppm, even if its boiling point is high, typically greater than 300° C. or even greater than 320° C., and its sulphur content will also be very low, typically less than 5 ppm. It is possible to use a reactor which comprises two or three catalytic beds or more. The catalysts can be present in variable or substantially equal quantities in each reactor, e.g. for three reactors according to weight quantities can be 0.05-0.5/0.10-0.70/0.25-0.85, preferably 0.07-0.25/0.15-0.35/0.4-0.78 and more preferentially 0.10-0.20/0.20-0.32/0.48-0.70.

Diluting the feedstock with the light and inert diluent according to the process of the invention makes it possible to limit the deactivation of the catalytic beds of the reactors of the hydrogenation section, and thus prolong the service life of the catalysts with respect to dilution with the hydrogenated effluent of a conventional process. It is presumed that this is due to the absence of aromatic compounds in the light and inert diluent. Advantageously, the process according to the invention makes it possible to obtain a conversion rate of the aromatic compounds comprised between 95 and 100%, preferably between 98 and 99.99%. The process according to the present invention advantageously makes it possible to limit the deactivation of the catalytic beds to less than 0.05 ppm of monoaromatics/hour, preferably to less than 0.01 ppm of monoaromatics/hour.

Recycling:

At the outlet of the hydrogenation section, the inert and light diluent is separated from the hydrogenated product by distillation, preferably atmospheric or gentle vacuum distillation, and is then recycled to the inlet of the first reactor in series, thus making it possible to reuse the diluent by mixing with the feedstock to be treated. It may be necessary to insert quenches in the recycling system or between the reactors in order to cool the effluents between the reactors or catalytic beds so as to control the temperatures of each reactor.

In an embodiment, at least part of the inert and light diluent and/or the separated gases are recycled in the system for feeding the hydrogenation stages. This dilution helps to maintain the exothermicity of the reaction within controlled limits, in particular in the first stage. Recycling also allows heat to be exchanged before the reaction and also better control of the temperature.

The effluent from the hydrogenation unit mainly contains the hydrogenated product and hydrogen. Flash separators are used to separate effluents into a gaseous phase, mainly residual hydrogen, and a liquid phase, mainly hydrogenated hydrocarbons. The process can be carried out using three flash separators, one at high pressure, one at intermediate pressure and one at low pressure, very close to atmospheric pressure.

The gaseous hydrogen that is collected at the top of the flash separators can be recycled into the system for feeding the hydrogenation unit or at different levels in the hydrogenation units between the reactors. A flash separator enables separation with a liquid/vapour equilibrium stage. It is advantageously used in the present invention because it enables separation of a mixture of compounds having boiling points that are very far apart. A single stage enables good separation.

Distillation and Fractionation:

According to an embodiment, the final product is separated at atmospheric pressure. It then feeds the vacuum fractionation unit directly. Preferably, fractionation will take place at a pressure comprised between 10 and 50 mbar and more preferentially at approximately 30 mbar.

Fractionation can be carried out in such a way that it is simultaneously possible for various hydrocarbon-containing fluids to be removed from the fractionation column and for their boiling point to be predetermined. A distillation column establishes the separation of mixtures with several liquid/vapour equilibrium stages with at least 3 stages. For a given mixture, the closer the boiling points of the compounds, the higher the number of separation stages.

The hydrogenation reactors, the separators and the fractionation unit can therefore be connected directly, without the need to use intermediate tanks. This integration of hydrogenation and fractionation enables an optimized thermal integration associated with a reduced number of devices and with energy savings.

Dearomatized Hydrocarbon-Containing Fluids Obtained by the Process:

The dearomatized hydrocarbon-containing fluids produced according to an embodiment of the process have a boiling temperature comprised between 100 and 400° C. and have a very low content of aromatics generally less than 300 ppm, preferably less than 100 ppm and more preferentially less than 50 ppm. The dearomatized hydrocarbon-containing fluids produced also have an extremely low sulphur content, less than 5 ppm, preferably less than 3 ppm and more preferentially less than 0.5 ppm, at a level too low to be detectable by means of conventional analyzers that are capable of measuring very low sulphur contents.

The dearomatized hydrocarbon-containing fluids products also advantageously have:

- a content of naphthenes less than 60% by weight, in particular less than 50% or even less than 40% and/or
- a content of polynaphthenes less than 30% by weight, in particular less than 25% or even less than 20% and/or
- a content of paraffins greater than 40% by weight, in particular greater than 60% or even greater than 70% and/or
- a content of isoparaffins greater than 20% by weight, in particular greater than 30% or even greater than 40%

Moreover, the dearomatized hydrocarbon-containing fluids produced have remarkable properties in terms of aniline point or solvent power, molecular weight, vapour pressure, viscosity, defined evaporation conditions for systems for which drying is important and defined surface tension. The dearomatized hydrocarbon-containing fluids produced according to an embodiment of the process can be used, alone or in a mixture, as drilling fluids, as industrial solvents, as cutting fluids, as rolling oils, as electro-discharge machining fluids, as rust preventatives in industrial lubricants, as dilution oils, as viscosity reducers in formulations based on plasticized polyvinyl chloride, as crop protection fluids. The dearomatized hydrocarbon-containing fluids produced according to an embodiment of the process can also be used, alone or in a mixture, in coating fluids, in metal extraction, in the mining industry, in explosives, in mould release formulations for concrete, in adhesives, in printing inks, in metal working fluids, in sealing products or polymer formulations based on silicone, in resins, in pharmaceutical products, in cosmetic formulations, in paint compositions, in polymers used in water treatment, in paper manufacture or in printing pastes or cleaning solvents.

EXAMPLES

In the remainder of the present description, examples are given by way of illustration of the present invention and are in no way intended to limit the scope.

Properties of the Feedstocks to be Treated, the Diluents and the Mixtures:

Comparative tests were carried out between the treatment of a fresh feedstock, by "fresh feedstock" is meant a typical refinery feedstock to be treated as described above, in a mixture with a light and inert diluent having a distillation range DR (in ° C.) comprised between 100 and 250° C. according to the standard ASTM D-86 and the difference between the Initial Boiling Point and the Final Boiling Point of which is less than or equal to 80° C. as described above, and the treatment of a fresh feedstock in a mixture with its hydrogenated effluent as described in the state of the art.

- ULSD feedstock: the starting fresh feedstock is a ULSD diesel, a commercial conventional refinery feedstock.
- IP 140: a diluent as described above is taken as reference: (sane-140 (also called IP 140) predominantly composed of $C_{10}$-$C_{12}$ isoparaffins, said diluent being marketed by the company Total Fluids and corresponding to the above definition of a light and inert diluent.
- Hydrogenated ULSD: the hydrogenated effluent is obtained from the hydrogenated starting fresh feedstock in a conventional hydrogenation process.

Table 1 shows the physicochemical properties of the fresh ULSD feedstock and of the corresponding fresh hydrogenated feedstock.

TABLE 1

| Analyses | Units | ULSD feedstock | Hydrogenated ULSD |
|---|---|---|---|
| Density at 15° C., ASTM D-4052 | g/ml | 0.8609 | 0.8423 |
| Flash point ASTM D-93 | ° C. | 86 | 72 |
| Pour point ASTM D-5950 (rep. D-97) | ° C. | −18 | −18 |
| Sulphur content measured by IC, ISO 20846 | ppm by weight | 2.71 | <1.19 |

TABLE 1-continued

| Analyses | Units | ULSD feedstock | Hydrogenated ULSD |
|---|---|---|---|
| Kinematic viscosity at 20° C., ASTM D-445 | mm2/s | 5.385 | 5.5 |
| Kinematic viscosity at 40° C., ASTM D-445 | mm2/s | 3.265 | 3.342 |
| Total nitrogen, ASTM D-4629 | ppm | 0.5 | <0.5 |
| Monoaromatics by HPLC IP 391 | % by weight | 31 | — |
| Diaromatics by HPLC IP 391 | % by weight | 6 | — |
| Triaromatics by HPLC IP 391 | % by weight | 0.4 | — |
| Total aromatics by HPLC IP 391 | % by weight | 37.4 | — |
| Monoaromatics by UV | ppm by weight | not relevant | 554 |
| ASTM D-86 Distillation Initial Boiling Temperature | ° C. | 200.2 | 195.9 |
| T ° C. at 5% vol | ° C. | 227.9 | 221.1 |
| T ° C. at 10% vol | ° C. | 237.1 | 230.8 |
| T ° C. at 20% vol | ° C. | 249.9 | 243.4 |
| T ° C. at 30% vol | ° C. | 260.1 | 253.1 |
| T ° C. at 40% vol | ° C. | 269.5 | 263.8 |
| T ° C. at 50% vol | ° C. | 279.1 | 273.5 |
| T ° C. at 60% vol | ° C. | 289.4 | 284.5 |
| T ° C. at 70% vol | ° C. | 299.9 | 294.9 |
| T ° C. at 80% vol | ° C. | 313.1 | 308.1 |
| T ° C. at 90% vol | ° C. | 330.5 | 326.2 |
| T ° C. at 95% vol | ° C. | 345.5 | 341.2 |
| Final Boiling Temperature | ° C. | 351.6 | 348.7 |
| Volume recovered | vol % | 98.2 | 98 |
| Residue | vol % | 1.8 | 2 |
| Volume lost | vol % | 0 | 0 |

Table 2 shows the main physicochemical characteristics of the diluents used.

TABLE 2

| Analyses | Units | IP 140 | Hydrogenated ULSD |
|---|---|---|---|
| Density at 15° C., ASTM D-4052 | g/ml | 0.7740 | 0.8423 |
| Sulphur content measured by IC, ISO 20846 | ppm by weight | <1.19 | <1.19 |
| Monoaromatics by UV | ppm by weight | 15 | 554 |
| ASTM D-86 Distillation Initial Boiling Temperature | ° C. | 141 | 195.9 |
| ASTM D-86 Distillation Final Boiling Temperature | ° C. | 164 | 348.7 |

Table 3 shows the quantity of aromatic compounds present in the different mixed feedstocks tested and their density. The mixtures are composed of 35% by weight of fresh ULSD feedstock and 65% by weight of diluent.

TABLE 3

| Analyses | Units | ULSD feedstock/IP 140 | ULSD feedstock/ Hydrogenated ULSD |
|---|---|---|---|
| Density at 15° C., ASTM D-4052 | g/ml | 0.8012 | 0.8488 |
| Monoaromatics by HPLC IP 391 | % by weight | 12.7 | 13 |
| Diaromatics by HPLC IP 391 | % by weight | 3.2 | 3.3 |
| Triaromatics by HPLC IP 391 | % by weight | 0.3 | 0.2 |
| Total aromatics by HPLC IP 391 | % by weight | 16.2 | 16.5 |

The differences in quantity of aromatic compounds between the different feedstocks tested are minimal and do not influence the analytical comparison of the results obtained. In order to be able to work at a constant mass flow, the liquid hourly space velocity (LHSV) has been adapted to the differences in density of the feedstocks tested according to a method well known to a person skilled in the art.

Operating Conditions:

The pilot unit is composed of 2 reactors in series loaded with 112 ml of HTC-700 type catalyst by Johnson-Matthey. The catalyst is equivalently distributed between the 2 reactors and mixed with silicon carbide SiC 0.1 mm in a proportion of 50/50% by volume. Catalytic activation is carried out according to the procedure recommended by Johnson-Matthey:

- Drying under nitrogen $N_2$ (80 NI/h) at 150° C. for 1 hour (heating rate: 60° C./h)
- Cooling to a temperature less than 40° C., then reduction under hydrogen $H_2$ at a pressure of 50 barg (20-25 NI/h) according to the following temperature plateaux:
  - At the rate of 60° C./h: increase in temperature to 120° C. and stabilization for 1 hour.
  - At the rate of 60° C./h: increase in temperature to 230° C. and stabilization for 3 hours.
  - Cooling to 150° C. before passing to the stabilization phase.

The stabilization phase is carried our using a conventional refinery gasoil, for example D0 gasoil from the ZR refinery (Zeeland refinery) and is maintained for several days under the operating conditions described in Table 4.

TABLE 4

| | |
|---|---|
| Pressure (barg) | 100 |
| LHSV ($h^{-1}$) | 1.5 |
| $H_2$/HC (Nl/l*) | 100 |
| Temperature (° C.) | 150 |

*normal liters per liter

Table 5 contains the physicochemical properties of the D0 feedstock compared with the ULSD feedstock/hydrogenated ULSD.

TABLE 5

| Analyses | Units | D0 gasoil | Feedstock tested (65/35% by weight of hydrogenated ULSD/ULSD feedstock) |
|---|---|---|---|
| Density at 15° C., ASTM D-4052 | g/ml | 0.8132 | 0.8488 |
| Flash point ASTM D-93 | ° C. | 112.5 | 75 |
| Pour point ASTM D-5950 (rep. D-97) | ° C. | −27 | −18 |
| Sulphur content measured by IC, ISO 20846 | ppm by weight | 1.16 | 1.39 |

TABLE 5-continued

| Analyses | Units | D0 gasoil | Feedstock tested (65/35% by weight of hydrogenated ULSD/ULSD feedstock) |
|---|---|---|---|
| Kinematic viscosity ASTM D-445 at 20° C. | Ppm | <0.5 | <0.5 |
| Kinematic viscosity ASTM D-445 at 40° C. | % by weight | 5.8 | 13.3(*) |
| Total nitrogen, ASTM D-4629 | % by weight | 0.7 | 3.4(*) |
| Monoaromatics by HPLC IP 391 | % by weight | <0.1 | 0.2(*) |
| Diaromatics by HPLC IP 391 | % by weight | 6.5 | 16.9(*) |
| Triaromatics by HPLC IP 391 | ° C. | 247.1 | 196.8 |
| Total aromatics by HPLC IP 391 | ° C. | 255.1 | 224.1 |
| Monoaromatics by UV | ° C. | 259.5 | 233.9 |
| ASTM D-86 Distillation Initial Boiling Temperature | ° C. | 264.2 | 246.5 |
| T ° C. at 5% vol | ° C. | 269.8 | 256.4 |
| T ° C. at 10% vol | ° C. | 275.2 | 266.8 |
| T ° C. at 20% vol | ° C. | 279.9 | 276.2 |
| T ° C. at 30% vol | ° C. | 286.2 | 286.7 |
| T ° C. at 40% vol | ° C. | 293.4 | 297.8 |
| T ° C. at 50% vol | ° C. | 302.4 | 311.3 |
| T ° C. at 60% vol | ° C. | 314.6 | 330.7 |
| T ° C. at 70% vol | ° C. | 324.2 | 347.1 |
| T ° C. at 80% vol | ° C. | 328.1 | 352 |
| T ° C. at 90% vol | % by volume | 97.8 | 98.4 |
| T ° C. at 95% vol | % by volume | 2.2 | 1.6 |
| Final Boiling Temperature | % by volume | 0 | 0 |

The stabilization phase is stopped when the quantity of monoaromatics in the effluent from the pilot unit (measured twice a day) reaches a stable value of approximately 11 ppm by weight. The different feedstocks are then introduced into the pilot unit and the temperature is gradually increased (5° C./h) up to 150° C. Table 6 shows the operating conditions applied during treatment of the different mixtures of feedstocks tested.

TABLE 6

| | Condition no. | |
|---|---|---|
| | 1 | 2 |
| Feedstock | ULSD feedstock/IP 140 | ULSD feedstock/ Hydrogenated ULSD |
| Pressure (bar) | 150 | 150 |
| LHSV ($h^{-1}$) | 1.1 | 1 |
| Feedstock flow rate (ml/h) | 123 | 112 |
| $H_2$/HC (Nl/l) | 122 | 134 |
| $H_2$ flow rate (Nl/h) | 15 | 15 |
| Reactor 1 Temperature (° C.) | 162 | 162 |
| Reactor 2 Temperature (° C.) | 187 | 187 |

Figure 2:
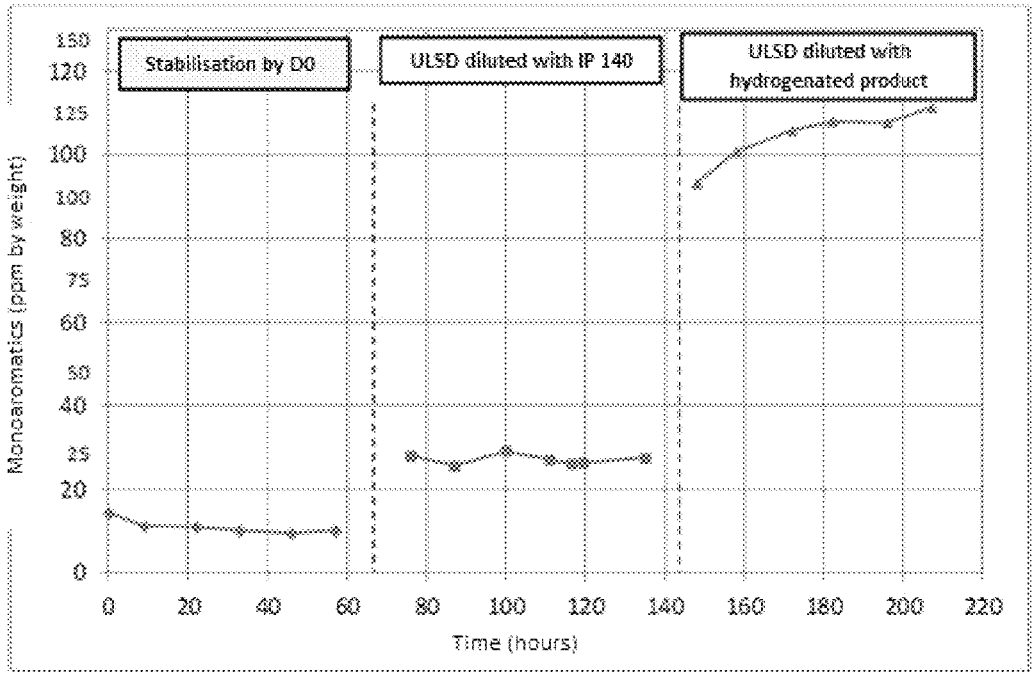

Results:

FIGS. 1 and 2 show the changes in the quantity of monoaromatic compounds in the effluent from the pilot unit as a function of time during treatment of the mixtures of USLD feedstock/hydrogenated ULSD and ULSD feedstock/IP 140. During assessment of the ULSD feedstock on HTC 700 catalyst, the monoaromatic compounds of the effluent from the pilot unit gradually increase, indicating a rapid and progressive deactivation of the catalyst. The deactivation rate can be assessed at 0.2 ppm monoaromatics/hour (FIG. 1). Conversely, using Isane-140 as diluent, the quantity of aromatic compounds remains stable and very low over time. The deactivation rate can be evaluated at less than 0.01 ppm monoaromatics/hour (FIG. 2).

When a ULSD feedstock/hydrogenated ULSD is passed through, deactivation is confirmed (FIG. 2). The quantity of aromatic compounds found in the effluent from the pilot unit is almost 4 times higher than when the feedstock is diluted with IP 140. The deactivation rate during ULSD feedstock/hydrogenated ULSD treatment can be evaluated at 0.3 ppm monoaromatics/hour, which is close to the deactivation rate found in FIG. 1. These results also show that the catalytic deactivation mechanism is the same with a new catalyst or with a catalyst already exposed to a feedstock. In fact, the appearance of the curve obtained for the ULSD feedstock/hydrogenated ULSD in FIGS. 1 and 2 is identical.

Without being bound by the theory, it is thought that certain monoaromatic compounds that are precursors of coke are partly responsible for the increased deactivation of the catalytic beds. The principal difference between IP 140 and hydrogenated ULSD is the presence in the latter of remaining monoaromatic compounds (approximately 560 ppm by weight). These compounds are considered as refractory because they are not hydrogenated in the unit. The deactivation is therefore suspected to be specifically caused by the quantity of monoaromatic or naphtheno-aromatic compounds contained in the feedstock to be treated. These monoaromatic compounds are considered as having a strong tendency to be precursors of coke. Coke is itself known for its ability to lead to an increased deactivation of the catalytic beds.

The conversion rate of the aromatic compounds can be approximately calculated by considering that the impact of the change in the density on the result of the calculation is negligible, and that the contribution of 35% by weight of ULSD feedstock is approximately 16% of the aromatic compounds in all hypothetical cases. The conversion rate for a feedstock prepared with IP 140 (the quantity of output aromatics is approximately 25 ppm by weight in this case and is assessed by UV measurement of the monoaromatic compounds of the effluent) is:

$$\frac{AROS_{input} - AROS_{output}}{AROS_{input}} = \frac{16 - 0.0025}{16} \times 100 = 99.98\%$$

The conversion rate for a feedstock prepared with hydrogenated ULSD (the quantity of output aromatics is approximately 120 ppm by weight in this case and is assessed by UV measurement of the monoaromatic compounds of the effluent) is:

$$\frac{AROS_{input} - AROS_{output}}{AROS_{input}} = \frac{(16 + 0.0370) - 0.0120}{(16 + 0.0370)} \times 100 = 99.92\%$$

The use of a light and inert diluent such as the diluent IP 140 therefore makes it possible not only to improve the stability of the catalyst but also to obtain a higher conversion of aromatics. The performance of the dearomatization unit is therefore greatly improved using the process according to the invention. In fact, the refractory aromatic compounds are not recycled into the catalytic section. In fact, the light and inert diluent does not contain aromatic compounds.

Instead of using the recycled hydrogenated effluent to dilute the fresh feedstock, this fresh feedstock is diluted with an inert and light solvent as described. This diluent can easily be separated from the hydrogenated product obtained by distillation, preferably atmospheric or gentle vacuum distillation. The required specifications of monoaromatic compounds in the final product are therefore respected without introducing an increased deactivation of the catalysts of the hydrogenation section. After separation from the product, the diluent is recycled to the process inlet.

The process as described thus makes it possible to treat conventional refinery feedstocks that are initially unsuitable and inappropriate for the production of hydrocarbon-containing fluids as sought. Only minor changes to the hydrogenation process are necessary. A single piece of equipment enabling the separation of the inert and light diluent from the final product needs to be added to the outlet of the hydrogenation section and the fractionation section. FIG. 3 is a diagrammatic representation of the process according to a particular embodiment.

The invention claimed is:

1. A process for dearomatization of a petroleum cut comprising producing a dearomatized hydrocarbon-containing fluid having a sulphur content less than or equal to 5 ppm and having a content of aromatic compounds less than or equal to 300 ppm, the hydrocarbon-containing fluid having a boiling point comprised between 100 and 400° C. according to the standard ASTM D-86 and a distillation range defined by the difference between an Initial Boiling Point (IBP) and a Final Boiling Point (FBP) determined in accordance with the standard ASTM D-86 not exceeding 80° C., the process further comprising at least one dearomatization cycle utilizing a mixture of the petroleum cut with one or more inert and light diluent, wherein:

the petroleum cut is an ultra-low sulphur diesel obtained by a hydrodesulphurization of straight run gasoil cuts from atmospheric distillation, the petroleum cut being devoid of hydrocracked vacuum gasoil (HCVGO), the one or more inert and light diluent has a boiling point in the range of 141 to 164° C. according to the standard ASTM D-86, has a distillation range not exceeding 80° C., has a content of aromatics less than 50 ppm measured by UV spectrometry, has a sulphur content less than 2 ppm according to the standard ASTM D-5453, and consists of a majority of isoparaffins and a minority of normal paraffins, wherein a mass ratio between the petroleum cut and the one or more inert and light diluent is comprised between 30/70 and 50/50, and the dearomatization is a catalytic hydrogenation carried out at a temperature between 160 and 200° C. and at a pressure between 100 and 160 bar in the presence of a nickel-based catalyst.

2. The process according to claim 1, wherein the Final Boiling Point of the one or more inert and light diluent is less than the Initial Boiling Point of the petroleum cut to be treated by at least 10° C.

3. The process according to claim 1, wherein the one or more inert and light diluent contains more than 90% by weight of isoparaffins.

4. The process according to claim 1, wherein the one or more inert and light diluent has a content of benzene compounds less than 10 ppm by weight according to the standard ASTM D-6229.

5. The process according to claim 1, wherein the one or more inert and light diluent has a kinematic viscosity at 20° C. comprised between 0.75 and 2.04 $mm^2/s$ according to the standard EN ISO 3104.

6. The process according to claim 1, wherein the one or more inert and light diluent is a hydrocarbon-containing cut obtained by atmospheric distillation, vacuum distillation, catalytic cracking, oligomerization and/or hydrogenation of crude oil.

7. The process according to claim 1, wherein the one or more inert and light diluent is a hydrocarbon-containing cut obtained by the oligomerization and hydrogenation of a propylene cut or a butylene cut.

8. The process according to claim 1, wherein the one or more inert and light diluent is a gasoline cut or a kerosene cut originating from the oligomerization and hydrogenation of a propylene cut or a butylene cut.

9. The process according to claim 1, wherein the petroleum cut contains a sulphur content less than 15 ppm according to the standard EN ISO 20846.

10. A method for improving hydrogenation yield and reducing deactivation of a hydrogenation catalyst, said method comprising the steps of:

a) mixing an inert and light diluent having a boiling point in the range of 141 to 164° C. according to the standard ASTM D-86, a distillation range not exceeding 80° C., having a content of aromatics less than 50 ppm measured by UV spectrometry, having a sulphur content less than 2 ppm according to the standard ASTM D-5453 and consisting of a majority of isoparaffins and a minority of normal paraffins, with a petroleum cut, wherein the petroleum cut is an ultra-low sulphur diesel obtained by a hydrodesulphurization of straight run gasoil cuts from atmospheric distillation, the petroleum cut being devoid of hydrocracked vacuum gasoil (HCVGO), wherein a mass ratio between the petroleum cut and the one or more inert and light diluent is comprised between 30/70 and 50/50;

b) subjecting the mixture to at least one dearomatization cycle, wherein the dearomatization is a catalytic hydrogenation carried out at a temperature between 160 and 200° C. and at a pressure between 100 and 160 bar in the presence of a nickel-based catalyst.

11. The process according to claim 1, wherein the one or more inert and light diluent is constituted by branched C7-C14 alkanes.

12. The process according to claim 11, wherein the one or more inert and light diluent is constituted by branched C9-C12 alkanes.

13. The process according to claim 3, wherein the one or more inert and light diluent contains more than 99% by weight of isoparaffins.

14. The process according to claim 1, wherein the one or more inert diluent is constituted by a majority of C10-C12 isoparaffins.

* * * * *